US006313082B1

(12) United States Patent
Scialla et al.

(10) Patent No.: US 6,313,082 B1
(45) Date of Patent: Nov. 6, 2001

(54) BLEACHING COMPOSITIONS

(75) Inventors: Stefano Scialla, Rome; Andrea Briatore, Savona; Gloria Di Capua, Ardea, all of (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/381,929

(22) PCT Filed: Mar. 18, 1998

(86) PCT No.: PCT/IB98/00378

§ 371 Date: Sep. 27, 1999

§ 102(e) Date: Sep. 27, 1999

(87) PCT Pub. No.: WO98/43915

PCT Pub. Date: Oct. 8, 1998

(51) Int. Cl.[7] ..... C11D 3/395

(52) U.S. Cl. ..... 510/380; 510/302

(58) Field of Search ..... 510/376, 380, 510/302

(56) References Cited

U.S. PATENT DOCUMENTS

| | | | |
|---|---|---|---|
| 3,639,284 | 2/1972 | Long et al. | 252/99 |
| 4,681,696 | 7/1987 | Bruegge et al. | 252/99 |
| 5,746,936 | 5/1998 | Mercado | 252/187.25 |

*Primary Examiner*—Yogendra N. Gupta
*Assistant Examiner*—John M Petruncio
(74) *Attorney, Agent, or Firm*—Jason J. Camp; Eileen L. Hughett

(57) ABSTRACT

Hypochlorite bleaching compositions comprise a phosphate ingredient, for improved fabric whiteness and improved fabric safety.

11 Claims, No Drawings

BLEACHING COMPOSITIONS

FIELD OF THE INVENTION

The present invention relates to bleaching compositions, in particular to hypochlorite bleaching compositions, suitable for use in laundry applications such as hand and machine laundry methods.

BACKGROUND OF THE INVENTION

Bleaching compositions are well-known in the art. Amongst the different bleaching compositions available, those relying on bleaching by hypohalite bleaches such as hypochlorite are often preferred, mainly for performance reasons, especially at lower temperature.

However, a problem encountered with the use of hypochlorite based-compositions is the resulting damage and/or yellowing of the fabrics being bleached.

It is therefore an object of the invention to provide a hypohalite-containing composition, suitable for use in laundry applications, which provides improved fabric whiteness to fabrics treated therewith.

It is another object of the invention to provide a hypohalite-containing composition, suitable for use in laundry applications, which provides improved fabric safety to fabrics treated therewith.

The Applicant has thus now surprisingly found that this problem is solved by the provision, in a hypohallite bleaching composition, of a phosphate ingredient. Indeed, it has been found that improved fabric whiteness and/or safety were obtained with the composition of the invention compared to hypohalite compositions without said phosphate ingredient. The benefits are particularly noticeable in hypohalite bleaching compositions which further comprise a pH buffering component.

Another advantage of the compositions of the invention is that they are chemically stable. By "chemically stable", it is meant that the hypohalite bleaching compositions of the present invention should not undergo more than 15% loss of available chlorine after 5 days of storage at 50° C. ±0.5° C. The % loss of available chlorine may be measured using the method described, for instance, in "Analyses des Eaux et Extraits de Javel" by "La chambre syndicate nationale de L'eau de Javel et des produits connexes", pages 9–10 (1984). Said method consists in measuring the available chlorine in the fresh compositions, i.e. just after they are made, and in the same compositions after 5 days at 50° C.

A further advantage of the compositions of the invention is that they are suitable for the bleaching of different types of fabrics including natural fabrics (e.g., fabrics made of cofton, viscose, linen, silk and wool), synthetic fabrics such as those made of polymeric fibers of synthetic origin as well as those made of both natural and synthetic fibers. Indeed, the compositions of the present invention may be used on synthetic fibers despite a standing prejudice against the use of hypohalite bleaches, especially hypochlorite bleaches, on synthetic fibers, as evidenced by warning on labels of commercially available hypochlorite bleaches and clothes.

EP 0 188 145 discloses bleaching compositions comprising trisodium phosphate. J53081789 discloses compositions comprising hypochlorite and a phosphate ingredient for the cleaning of carpets. J03137278 discloses a composition comprising hypochlorite and a phosphate ingredient for the bleaching of indigo-dyed cloth. J08081878 discloses bleaching compositions with a phosphate ingredient for the bleaching of raw textiles. None of these prior art documents discloses the fabric whiteness and safety benefits obtained from the provision of a phosphate ingredient in a hypochlorite composition.

SUMMARY OF THE INVENTION

The present invention is a liquid or solid bleaching composition comprising

- a hypohalite bleach,
- a pH buffering component in an amount of 0.5% to 9% by weight, and
- an effective amount of a phosphate ingredient.

The present invention also encompasses a process of treating fabrics where said fabrics are immersed in a bleaching solution formed by diluting said bleaching composition in water.

The present invention further encompasses the use, in a hypohalite bleaching composition, of a phosphate ingredient, for providing improved fabric whiteness and/or safety to the fabrics treated therewith.

DETAILED DESCRIPTION OF THE INVENTION

Hypohalite bleach

An essential component of the invention is a hypohalite bleach. Hypohalite bleaches may be provided by a variety of sources, including bleaches that are oxidative bleaches and subsequently lead to the formation of positive halide ions as well as bleaches that are organic based sources of halides such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

For liquid compositions, the preferred hypohalite bleaches among the above described are the alkali metal and/or alkaline earth metal hypochlorites selected from the group consisting of sodium, potassium, magnesium, lithium and calcium hypochlorites, and mixtures thereof, more preferably the alkali metal sodium hypochlorite.

For solid compositions, the preferred hypohalite bleaches among the above described are the alkali metal and/or alkaline earth metal hypochlorites selected from the group consisting of lithium hypochlorites, calcium hypochlorites, chlorinated trisodium phosphate dodecahydrates, potassium dichloroisocyanurates, sodium dichloroisocyanurates, potassium trichlorocyanurates, sodium trichlorocyanurates, and mixtures thereof, more preferably sodium dichloroisocyanurates and/or calcium hypochlorite. Preferably, the liquid compositions according to the present invention comprise said hypohalite bleach such that the content of active halide in the composition is of from 0.1% to 20% by weight, more preferably from 2% to 8% by weight, most preferably from 3% to 6% by weight of the composition. Preferably, the solid compositions according to the present invention comprise said hypohalite bleach such that the content of active halide in the composition is of from 20% to 95% by weight, more preferably from 25% to 60% by weight of the composition.

pH buffering component

A pH buffering component is another essential component for the compositions of the invention. The pH buffering component ensures that the pH of the composition is buffered to a pH value ranging from 7.5 to 13, preferably from 8 to 12, more preferably from 8.5 to 11.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, borates, metaborates, phosphates, stannates, alluminates and mixtures thereof, and preferably are selected from the group consisting of sodium carbonate, sodium silicate, sodium borate, and mixtures thereof.

The raw materials involved in the preparation of hypohalite bleaches usually contain by-products, e.g calcium carbonate resulting in an amount of up to 0.4% by weight of by-product within the hypohalite composition. However, at such amount, the by-product will not have the buffering action defined above.

Liquid bleaching compositions herein will contain an amount of pH buffering component of from 0.5% to 9% by weight, preferably from 0.5% to 5% by weight, and more preferably in an amount of from 0.6% to 3% by weight of the composition.

Solid bleaching compositions herein will preferably contain an amount of pH buffering component of from 3% to 30% by weight, more preferably from 5% to 25% by weight, and most preferably in an amount of from 10% to 20% by weight of the composition.

The Phosphate ingredient

Phosphonic acid can be condensed in the reaction

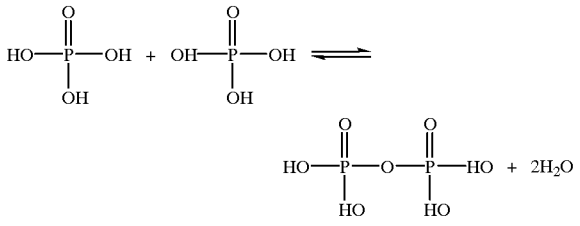

The reaction can be repeated with any of the reactive OH groups, and phosphate ingredients are obtained which can be linear or branched polyphosphates of structure

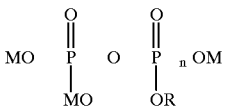

when R is M or

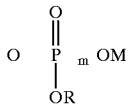

when M is a counterion, preferably alkali metal;

when 0 ≦n+m<500 (if n+m=0 then the compound is phosphonic acid)

cyclic polyphosphates (also referred to as metaphosphates), of structure

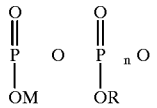

where R is M or

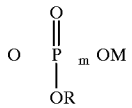

if R is

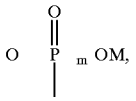

OR the phosphate compound contains both cycles and branched-chain, and can be referred to as an ultraphosphate.)

where M is a counterion, preferably an alkali metal where O≦n+m<500

All such phosphate ingredients are suitable for use herein, and preferred are linear phosphate ingredients (i.e. R is M) where n is 1 (pyrophosphate) and n is 2 (tripolyphosphate), most preferably where n is 2. The most commonly available form of these phosphate is where M is Sodium.

The phosphate ingredients herein are present in amounts of from 0.001% to 20%, preferably 0.005% to 5%, most preferably 0.005% to 1% by weight of the total composition. Of course, mixtures of different phosphate ingredients can be used.

The whitening effect, i.e. the yellowing-prevention effect, and/or safety effect of the present invention can be evaluated by comparing the composition according to the present invention to the same composition without the phosphate ingredient.

The degree of yellowing can be determined by both visual and instumental grading. Visually, the difference in yellowing between items treated with different compositions can be determined by a team of expert panellists. Instrumentally, the assessment can be determined with the help of Colorimeters such as Ganz Griesse® instruments (e.g., Datacolor® Spectraflash® SF 500, Machbet White-eye®) 500) or a ZEISS ELREPHO® or others which are available for instance from HunterIab®) or Gardner®.

Fabric safety may be evaluated by different test methods including the degree of polymerisation test method according to UNI (Ente Nazionale Italiano di Unificazione) official method UNI 8282-Determinazione. della viscosita intrinseca in soluzione di cuprietilendiammina (CED).

The compositions according to the present invention are either in liquid or solid form. Solid forms include forms such as powders, tablets and granules. Preferably, the compositions of the invention are in liquid aqueous form. More preferably, they comprise water in an amount of from 60% to 98% by weight, more preferably of from 80% to 97% and most preferably of from 85% to 97% by weight of the total aqueous liquid bleaching composition.

pH

The pH of the liquid compositions according to the present invention, as is, is typically from 12 to 14 measured at 25° C. Solid compositions or liquid compositions of the invention have a pH of from 7.5 to 13, preferably from 8 to 12, more preferably from 8.5 to 11.5, when diluted into 1 to 500 times its weight of water. It is in this alkaline range that the optimum stability and performance of the hypohalite as well as fabric whiteness and/or safety are obtained. The pH range is suitably provided by the pH buffering component and the hypohalite bleach mentioned hereinbefore, which are alkalis. However, in addition to these components, a strong source of alkalinity may also optionally be used.

Suitable sources of alkalinity are the caustic alkalis such as sodium hydroxide, potassium hydroxide and/or lithium hydroxide, and/or the alkali metal oxides such as sodium and/or potassium oxide. A preferred strong source of alkalinity is a caustic alkali, more preferably sodium hydroxide and/or potassium hydroxide. Typical levels of such caustic alkalis, when present, are of from 0.1% to 1.5% by weight, preferably from 0.5% to 1.5% by weight of the composition.

Optional polymers

An optional component of the compositions herein is a polymer. That polymer, has surprisingly been found to also reduce the yellowing of the fabrics treated therewith, i.e. improve whiteness, as well as improve fabric safety. Naturally, for the purpose of the invention, the polymer has to be stable to the hypohalite bleach.

Suitable polymers for use are polymers comprising monomeric units selected from the group consisting of unsaturated carboxylic acids, polycarboxylic acids, sulphonic acids, phosphonic acids and mixtures thereof. Co-polymerisation of the above monomeric units among them or with other co-monomers such as styrenesulfonic acid is also suitable.

Preferred examples of such polymers are the polymers and co-polymers of monomeric units selected from the group consisting of acrylic acid, maleic acid, vinylsulphonic acid and mixtures thereof. Also suitable for use herein are the above mentioned polymers and co-polymers which are modified in order to contain other functional groups such as aminophosphonic and/or phosphonic units. More preferred polymers are selected from the group consisting of polyacrylate polymers, co-polymers of acrylic and maleic acid, co-polymers of styrene sulphonic acid and maleic acid, and mixtures thereof, preferably modified with aminophosphonic and/or phosphonic groups.

The molecular weight for these polymers and co-polymers is preferably below 100,000, most preferably between 500 and 50,000. Most suitable polymers and co-polymers for use herein will be soluble in an amount up to 0.1% by weight, in an aqueous composition comprising 5% by weight of sodium hypochlorite with its pH adjusted to 13 with sodium hydroxide.

Commercially available such polymers, suitable for use herein, are the polyacrylate polymers sold under the tradename Good-Rite® from BF Goodrich, Acrysol® from Rohm & Haas, Sokalan® from BASF, Norasol® from Norso Haas. Also suitable for use herein are the co-polymers of styrene sulphonic acid and maleic acid, commercially available under the tradename Versaflex® from National Starch such as Versaflex 157, as well as Acumer® terpolymers from Rohm and Haas, in particular Acumer® 3100. Preferred commercially available polymers are the polyacrylate polymers, especially the Norasol® polyacrylate polymers and more preferred are the polyacrylate polymer Norasol® 410N (MW 10,000) and the polyacrylate polymer modified with phosphonic groups Norasol® 440N (MW 4000) and its corresponding acid form Norasol® QR 784 (MW 4000).

A preferred polymer for use herein is a polyacrylate polymer modified with phosphonic groups commercially available under the tradename Norasol® 440N (MW 4000) and its corresponding acid form Norasol® QR 784 (MW 4000) from Norso-Haas.

Mixtures of polymers as herein described may also be used in the present invention.

Polymers herein are preferably present in low amounts, i.e. in amounts of up to 0.5% by weight, more preferably from 0.001% to 0.3% by weight, most preferably from 0.005% to 0.2% by weight of the liquid composition.

The composition according to the invention may also comprise further optional components such as perfumes, bleach-stable surfactants, organic or inorganic alkalis, pigments, dyes, optical brighteners, solvents, chelating agents, radical scavengers and mixtures thereof.

Preferably, the compositions of the invention are used in diluted form in laundry applications. The expression "used in diluted form" herein includes dilution by the user, which occurs for instance in hand laundry applications, as well as dilution by other means, such as in a washing machine. Preferably, the composition is diluted into 5 to 500 times its weight of water for hand laundry application and 10 to 500 times its weight of water in a washing machine. Thus, in another aspect of the invention, there is provided a process for bleaching fabrics with a composition as disclosed herein, where said fabrics are immersed in a bleaching solution formed by diluting said composition in water.

In yet another aspect of the invention, there is provided the use, in a hypohalite bleaching composition, of a phosphate ingredient for providing improved whiteness and/or safety to the fabrics treated therewith. By "improved whiteness and/or safety", it is meant that hypohalite bleaching compositions, with the phosphate ingredient, provide better whiteness, i.e. less yellowing, and/or fabric safety compared to hypohalite bleaching compositions which do not comprise said phosphate ingredient. In this embodiment, the presence of a pH buffering component in the bleaching composition is not compulsory, but is highly preferred.

The invention is illustrated in the following non-limiting examples, in which all percentages are on a weight basis unless otherwise stated.

| Composition (weight %) | Examples 1 | 2 | 3 | 4 |
|---|---|---|---|---|
| Sodium hypochlorite | 5.0 | 5.0 | 5.0 | 2.5 |
| Sodium hydroxide | 0.9 | 0.7 | 0.7 | 0.7 |
| Sodium carbonate | 1.2 | 1.2 | 1.2 | 1.2 |
| Sodium silicate | — | 0.5 | — | — |
| Sodium metaborate | — | — | 1.0 | 1.0 |
| Sodium tripolyphosphate (STPP) | 0.05 | 0.1 | 0.5 | 1 |
| Water and minors | | up to 100% | | |

| Composition (weight %) | 5 | 6 | 7 | 8 | 9 |
|---|---|---|---|---|---|
| Sodium hypochlorite | 5.0 | 5.0 | 3.5 | 3.5 | 5 |
| Sodium hydroxide | 1 | 1.5 | 1 | 1.5 | 0.8 |
| Sodium carbonate | 1 | 2 | 2 | 1.5 | 2 |
| Sodium silicate | — | — | 0.5 | 0.5 | 0.5 |
| Sodium metaborate | — | — | — | — | — |
| Sodium tripolyphosphate | 0.1 | 0.05 | 0.2 | 0.3 | 1 |
| Norasol ® 440N | — | 0.1 | — | 0.2 | — |
| Norasol ® 410N | 0.05 | 0.1 | 0.1 | — | 0.1 |
| Water and minors | | up to 100% | | | |

What is claimed is:

1. A liquid bleaching composition comprising:

a hypohalite bleach, a pH buffering component in an amount of 0.5% to 9% by weight, wherein said pH buffering component is selected from the group consisting of alkali metal salts of carbonates, polycarbonates, sesquicarbonates, silicates, polysilicates, borates, metaborates, stannates, aluminates, and mixtures thereof; and a fabric whiteing and/or fabric safety enhancing effective amount of a phosphate ingredient.

2. A bleaching composition according to claim 1, wherein said pH buffering component is selected from the group consisting of sodium carbonate, sodium silicates, sodium borate, and mixtures thereof.

3. A bleaching composition according to claim 1 wherein said hypohalite bleach is an alkali metal sodium hypochlorite.

4. A bleaching composition according to claim 1 wherein said hypohalite, based on active halide, is present in an amount of from 0.1% to 20% by weight of the liquid composition.

5. A bleaching composition to claim 1 wherein said composition further comprises a strong source of alkalineity.

6. A bleaching composition according to claim 1 wherein said phosphate ingredient is of a structure selected from the group consisting of:

linear or branched polyphosphates of structure

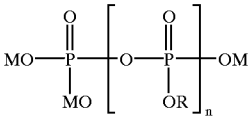

or cyclic polyphosphates (also referred to as metaphosphates), of structure

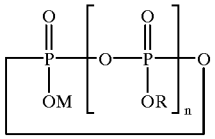

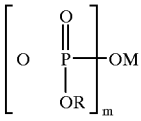

when M is a counterion, preferably alkali metal;

when $O \leqq n+m < 500$ (if $n+m=0$ then the compound is phosphoric acid) and mixtures thereof.

7. A bleaching composition according to claim 6, wherein said phosphate is sodium pyrophosphate or sodium tripolyphosphate.

8. A bleaching composition according to claim 1 wherein said composition comprises from about 0.001% to about 20% of said phosphate ingredient.

9. A bleaching composition according to claim 1 wherein said composition further comprises a polymer.

10. A bleaching composition according to claim 7 wherein said phosphate is sodium tripolyphosphate.

11. A process for bleaching fabrics comprising the step of contacting said fabric with a bleaching composition according to claim 1.

* * * * *